US006920854B2

(12) United States Patent
Komaki

(10) Patent No.: US 6,920,854 B2
(45) Date of Patent: Jul. 26, 2005

(54) VARIABLE VALVE ACTUATION APPARATUS FOR INTERNAL COMBUSTION ENGINE

(75) Inventor: Yusaku Komaki, Tochigi (JP)

(73) Assignee: Hitachi, Ltd., Tokyo-to (JP)

( * ) Notice: Subject to any disclaimer, the term of this patent is extended or adjusted under 35 U.S.C. 154(b) by 0 days.

(21) Appl. No.: 10/899,073

(22) Filed: Jul. 27, 2004

(65) Prior Publication Data

US 2005/0028773 A1 Feb. 10, 2005

(30) Foreign Application Priority Data

Aug. 8, 2003 (JP) ..... 2003-289671

(51) Int. Cl.[7] ..... F01L 1/34

(52) U.S. Cl. ..... 123/90.17; 123/90.16; 123/90.15; 464/161

(58) Field of Search ..... 123/90.17, 90.16; 464/161

(56) References Cited

U.S. PATENT DOCUMENTS 5,184,581 A * 2/1993 Aoyama et al. ..... 123/90.31
5,497,738 A * 3/1996 Siemon et al. ..... 123/90.17
6,250,266 B1 * 6/2001 Okui et al. ..... 123/90.17
6,311,654 B1 * 11/2001 Ushida et al. ..... 123/90.17
6,457,447 B1 * 10/2002 Sato et al. ..... 123/90.17
2001/0039933 A1 * 11/2001 Sato et al. ..... 123/90.17

FOREIGN PATENT DOCUMENTS

JP 2001-329811 A 11/2001

* cited by examiner

*Primary Examiner*—Thomas Denion
*Assistant Examiner*—Kyle M. Riddle
(74) *Attorney, Agent, or Firm*—Foley & Lardner LLP

(57) ABSTRACT

A VVA apparatus includes drive-input and intake-side transmission sprockets provided to an intake-side phase alteration device, an exhaust-side transmission sprocket provided to the exhaust-side phase alteration device, a reduced-diameter portion provided to a housing of the exhaust-side phase alteration device between a housing main body and the exhaust-side transmission sprocket, and a torsion coil spring arranged between the housing and vane rotor of the exhaust-side phase alteration device to bias the two in the advance direction. The torsion coil spring is disposed on the outer periphery of the reduced-diameter portion to have a reduced diameter when the phase is changed from the phase at engine start.

20 Claims, 3 Drawing Sheets

VARIABLE VALVE ACTUATION APPARATUS FOR INTERNAL COMBUSTION ENGINE

BACKGROUND OF THE INVENTION

The invention of the present application relates to a variable valve actuation (VVA) apparatus for an internal combustion engine, which controls the opening/closing timing of intake and exhaust valves in accordance with the engine operating conditions.

A typical VVA apparatus for an internal combustion engine is disclosed in Japanese document P2001-329811A. The VVA apparatus comprises phase alteration devices arranged at the front ends of intake and exhaust camshafts, respectively, to which torque of a crankshaft is transmitted through a chain. The intake-side phase alteration device comprises in a housing a drive-input sprocket or rotator for directly transmitting thereto torque of the crankshaft through the chain and an intake-side transmission sprocket or rotator which is a member separate and distinct from the drive-input sprocket. On the other hand, the exhaust-side phase alteration device comprises in a housing an exhaust-side transmission sprocket or rotator having the same outer diameter as that of the intake-side transmission sprocket. The chain is looped between the two transmission sprockets.

Since the camshaft of the four-cycle engine rotates at the 1:2 ratio with respect to the rpm of the crankshaft, the outer diameter (number of teeth) of the drive-input sprocket of the phase alteration device is determined by the outer diameter (number of teeth) of a crankshaft-side sprocket. Thus, the outer diameter of the drive-input sprocket cannot be reduced freely, whereas the size of the two transmission sprockets can be reduced up to a point by simply setting the outer diameters (numbers of teeth) to the same-value. Therefore, when adopting the above VVA apparatus, even with engine layout having the intake and exhaust camshafts disposed relatively close to each other, torque of the crankshaft can be transmitted to the intake-side and exhaust-side phase alteration devices.

A vane rotor integrated with the exhaust camshaft is relatively rotatably accommodated in the housing of the exhaust-side phase alteration device wherein the transmission sprocket is arranged on the outer periphery. The vane rotor comprises vanes protuberantly arranged on the outer periphery to divide an inside space of the housing into advance and retard chambers. Selective supply/discharge of working fluid from the advance and retard chambers is carried out suitably to produce relative rotation between the housing and the vane rotor. With such so-called vane-type phase alteration device, however, the vane rotor is often put back to its retard position by alternating torque of the camshaft at engine stop or start where the pressure of working fluid is low. Thus, application of the phase alteration device to the exhaust side as-is can impair smooth engine start. Therefore, in the VVA apparatus, a spiral spring serving as a return spring is arranged at the front end of the exhaust-side phase alteration device to bias the vane rotor to its advance position, whereby the vane rotor is put back to its advance position by a biasing force of the spiral spring at engine stop or start.

SUMMARY OF THE INVENTION

With the VVA apparatus disclosed in Japanese document P2001-329811A, however, since the spiral spring is arranged at the front end of the exhaust-side phase alteration device, the front-end portion of the exhaust-side phase alteration device protrudes forward by the length of an installation space of the spiral spring, increasing the block length of the engine in its entirety, leading to lowered vehicle mountability thereof.

It is, therefore, an object of the invention of the present application to provide a VVA apparatus for an internal combustion engine, which allows smooth engine start without increasing the axial length of an exhaust-side phase alteration device and contributes to enhancement in vehicle mountability of the engine provided with such phase alteration device.

The invention of the present application provides generally a variable valve actuation (VVA) apparatus for an internal combustion engine, which comprises: an intake camshaft which drives an intake valve; an exhaust camshaft which drives an exhaust valve; an intake-side phase alteration device arranged at one end of the intake camshaft, the intake-side phase alteration device changing a relative rotation phase between a crankshaft and the intake camshaft; an exhaust-side phase alteration device arranged at one end of the exhaust camshaft, the exhaust-side phase alteration device changing a relative rotation phase between the crankshaft and the exhaust camshaft; a drive-input rotator provided to the intake-side phase alteration device, the drive-input rotator receiving a torque of the crankshaft; an intake-side transmission rotator provided to the intake-side phase alteration device, the intake-side transmission rotator being disposed closer to the intake camshaft than the drive-input rotator, the intake-side transmission rotator being smaller in outer diameter than the drive-input rotator, the intake-side transmission rotator rotating together with the drive-input rotator; an exhaust-side transmission rotator which receives a torque of the intake-side transmission rotator, the exhaust-side transmission rotator being the same in outer diameter as the intake-side transmission rotator; a reduced-diameter portion arranged between the exhaust-side phase alteration device and the exhaust-side transmission rotator; and a biasing member which biases the exhaust camshaft to an advance direction with respect to the crankshaft, the biasing member having a reduced diameter when a phase of the exhaust-side phase alteration device is changed from its phase at engine start.

BRIEF DESCRIPTION OF THE DRAWINGS

The other objects and features of the invention of the present application will become apparent from the following description with reference to the accompanying drawings, wherein.

DETAILED DESCRIPTION OF THE INVENTION

Figure 1:
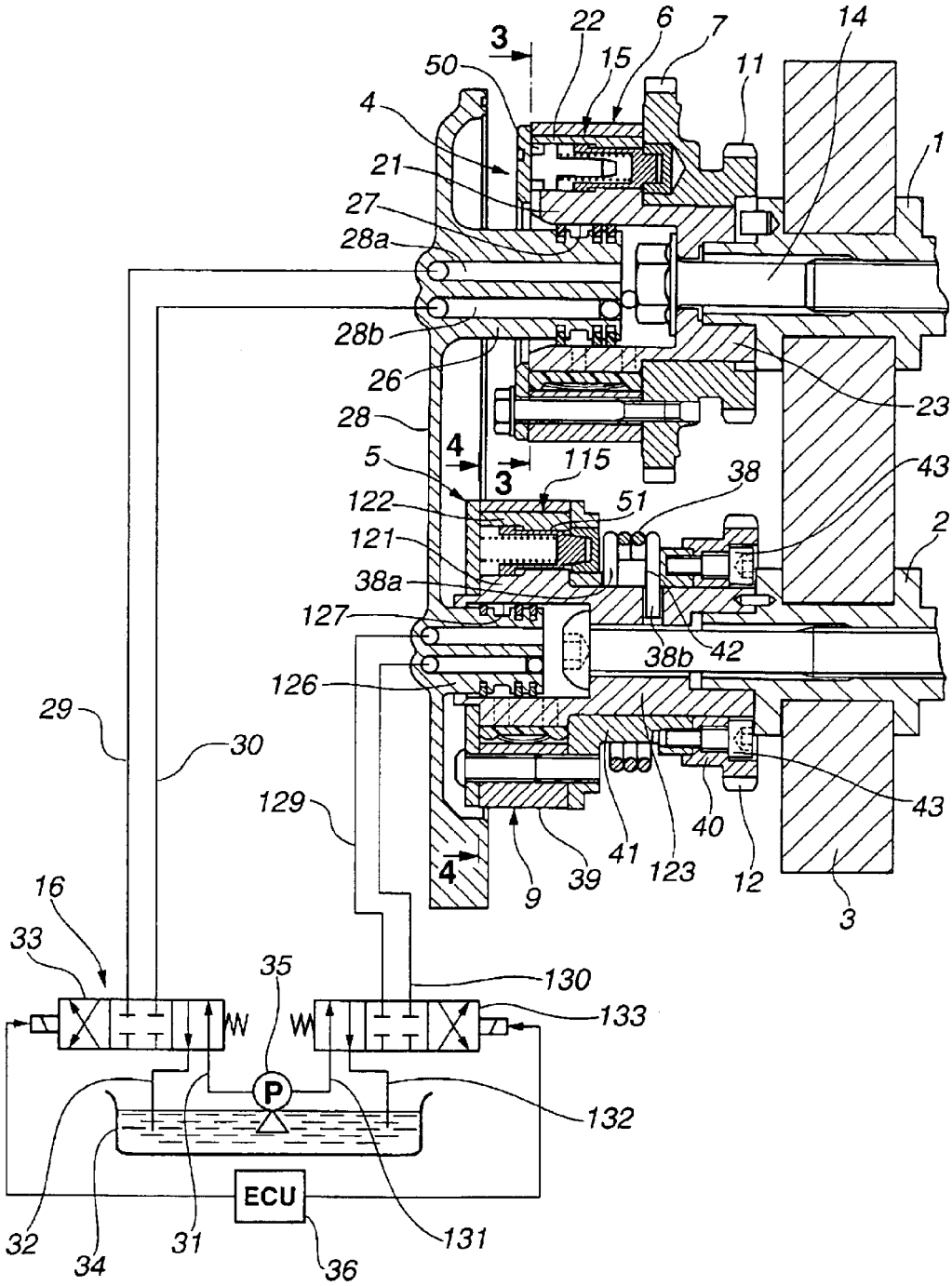
FIG. 1 is a sectional view taken along the line 1—1 in FIG. 2 and showing an embodiment of a VVA apparatus for an internal combustion engine according to the invention of the present application.

Referring to the drawings, a description will be made about a VVA apparatus for an internal combustion engine embodying the invention of the present application.

Referring to FIG. 1, the engine comprises intake and exhaust camshafts 1, 2 supported on a cylinder block 3.

Crank cams, not shown, are integrally mounted to camshafts 1, 2 so as to drive engine valves or intake and exhaust valves of cylinders in accordance with rotation of camshafts 1, 2.

Figure 2:
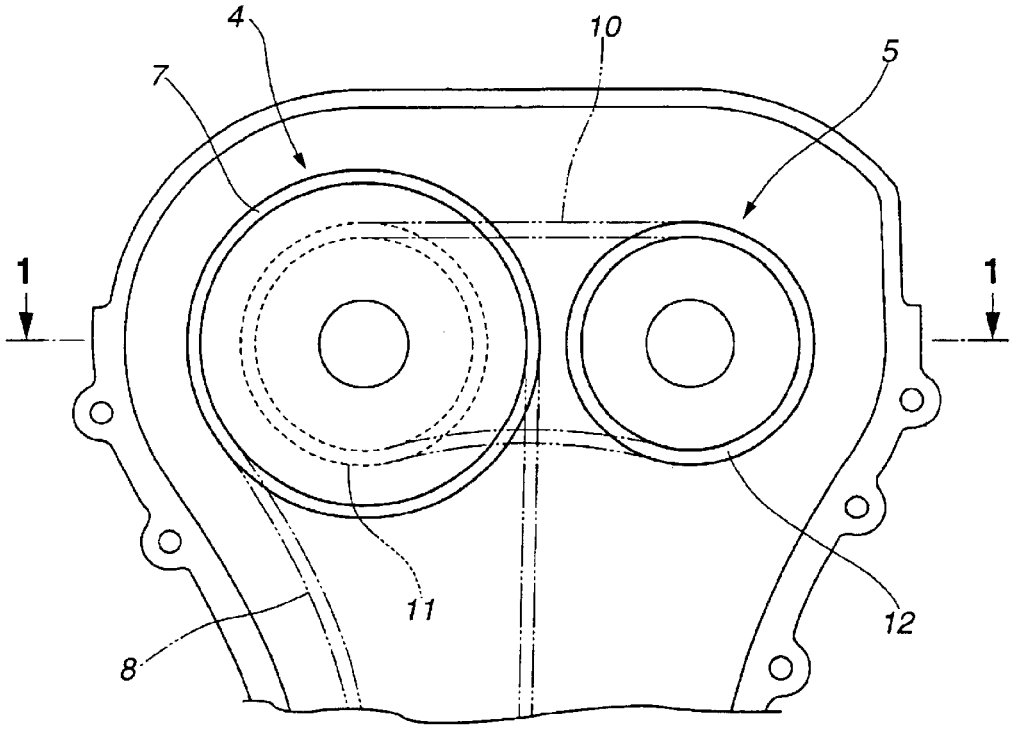
FIG. 2 is a schematic front view showing the VVA apparatus with a VTC cover removed.

Intake-side and exhaust-side phase alteration devices 4, 5 are mounted to camshafts 1, 2 at the front ends so as to control the relative rotation phase between a crankshaft, not shown, and camshafts 1, 2 in accordance with the engine operating conditions. Intake-side phase alteration device 4 comprises a housing 6 and a drive-input sprocket or rotator 7 formed therewith. Torque of the crankshaft is transmitted to housing 6 through a chain 8 (see FIG. 2) looped over drive-input sprocket 7. Since drive-input sprocket 7 rotates at the 1:2 ratio with respect to rotation of a crankshaft-side sprocket, drive-input sprocket 7 has an outer diameter set so that the number of teeth is twice as large as that of the crankshaft-side sprocket.

In the illustrative embodiment, intake and exhaust camshafts 1, 2 are disposed parallel and close to each other. Transmission of torque from the crankshaft to exhaust camshaft 2 is carried out from housing 6 of intake-side phase alteration device 4 (refer hereafter to as "intake-side housing 6") to a housing 9 of exhaust-side phase alteration device 5 (refer hereafter to as "exhaust housing 9") through a chain 10 (see FIG. 2). Specifically, an intake-side transmission sprocket or rotator 11 having small outer diameter than that of drive-input sprocket 7 is formed with intake-side housing 6 in the position closer to intake camshaft 1 than drive-input sprocket 7. And an exhaust-side transmission sprocket or rotator 12 having the same outer diameter (number of teeth) as that of intake-side transmission sprocket 11 is formed with exhaust-side housing 9 in the axial position corresponding to sprocket 11. Chain 10 is looped between intake-side and exhaust-side transmission sprockets 11, 12.

Intake-side and exhaust-side phase alteration devices 4, 5 are controlled in rotation by the hydraulic pressure, and have substantially the same structure. Therefore, first, the structure of intake-side phase alteration device 4 will be described, followed by a description about the structure of exhaust-side phase alteration device 5, principally, the structural difference between the two.

Figure 3:
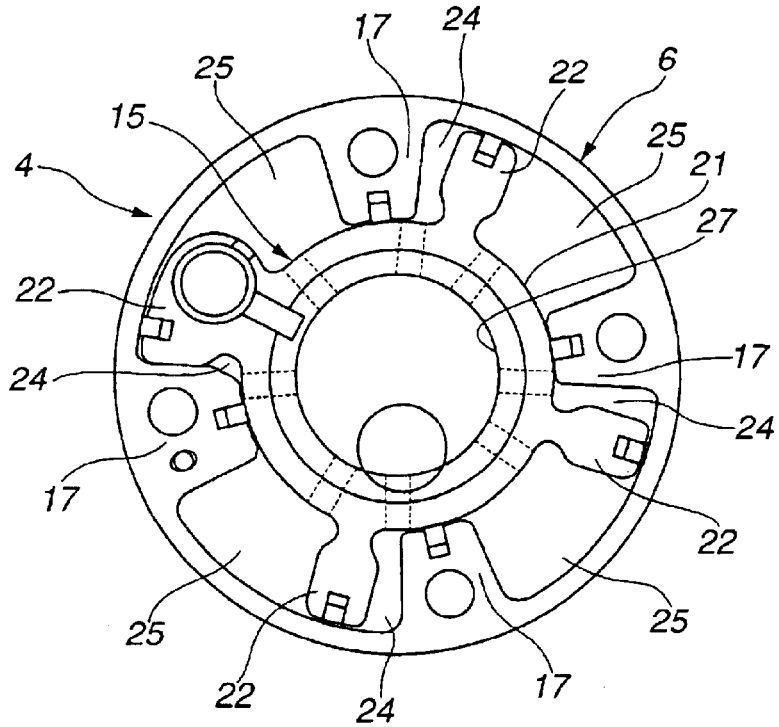
FIG. 3 is an end view seen from the line 3—3 in FIG. 1.

Referring to FIGS. 1 and 3, intake-side phase alteration device 4 comprises intake-side housing 6 having drive-input sprocket 7 and intake-side transmission sprocket 11 formed on the outer periphery, a vane rotor 15 integrally coupled to intake camshaft 1 by a cam bolt 14 and having intake-side housing 6 assembled thereto to relatively be rotatable as required, and a hydraulic-pressure supply/discharge means or device 16 for supplying/discharging working fluid to ensure relative rotation between vane rotor 15 and intake-side housing 6 in accordance with the engine operating conditions.

Referring to FIG. 3, intake-side housing 6 comprises four partition walls 17 of trapezoidal section equidistantly formed with the peripheral wall to protrude radially inward from the inner periphery. Drive-input sprocket 7 and intake-side transmission sprocket 11 are axially distantly arranged on the rear-side outer periphery of the peripheral wall of intake-side housing 6.

Vane rotor 15 comprises a rotor main body 21 disposed in the center of intake-side housing 6 and having an outer peripheral surface with which the front ends of partition walls 17 make slide contact, four vanes 22 protruding radially outward from rotor main body 21, and a shank 23 extending from one side of rotor main body 21 toward intake camshaft 1. Each vane 22 is disposed between adjacent partition walls 17 of intake-side housing 6 to divide a space between partition walls 17 into advance and retard chambers 24, 25. Shank 23 is arranged through intake-side housing 6 to be coupled to intake camshaft 1, and serves to rotatably support housing 6 at the through portion.

Formed in the center of the front face of vane rotor 15 is a connection hole 27 in which a supply/discharge rod 26 as will be described later is engaged relatively rotatably and through which working fluid is supplied/discharged from advance and retard chambers 24, 25.

Supply/discharge rod 26 is formed with the inside of a VTC cover 28 mounted to the front end of a cylinder head to protrude axially, and has inner passages 28*a*, 28*b* formed therethrough to fluidly communicate with advance and retard chambers 24, 25, respectively.

Referring to FIG. 1, hydraulic-pressure supply/discharge means 16 comprises first and second hydraulic passages 29, 30 for supplying/discharging working fluid from advance and retard chambers 24, 25 of intake-side phase alteration device 4, third and fourth hydraulic passages 129, 130 for supplying/discharging working fluid from advance and retard chambers 124, 125 of exhaust-side phase alteration device 5, an intake-side electromagnetic switching valve 33 for switching first and second hydraulic passages 29, 30 to one of a supply passage 31, a drain passage 32, and a holding position, and an exhaust-side electromagnetic switching valve 133 for switching third and fourth hydraulic passages 129, 130 to one of a supply passage 131, a drain passage 132, and a holding position. An oil pan 34 is arranged on the bottom of the engine, and an oil pump 35 is arranged to supply working fluid in oil pan 34. An electronic control unit (ECU) 36 serves to control electromagnetic switching valves 33, 133.

Exhaust-side phase alteration device 5 comprises exhaust-side housing 9, a vane rotor 115, hydraulic-pressure supply/discharge means 16 shared with intake-side phase alteration device 4, and a torsion coil spring 38 serving as a return spring for biasing vane rotor 115 and exhaust-side housing 9 to their advance positions.

Figure 4:
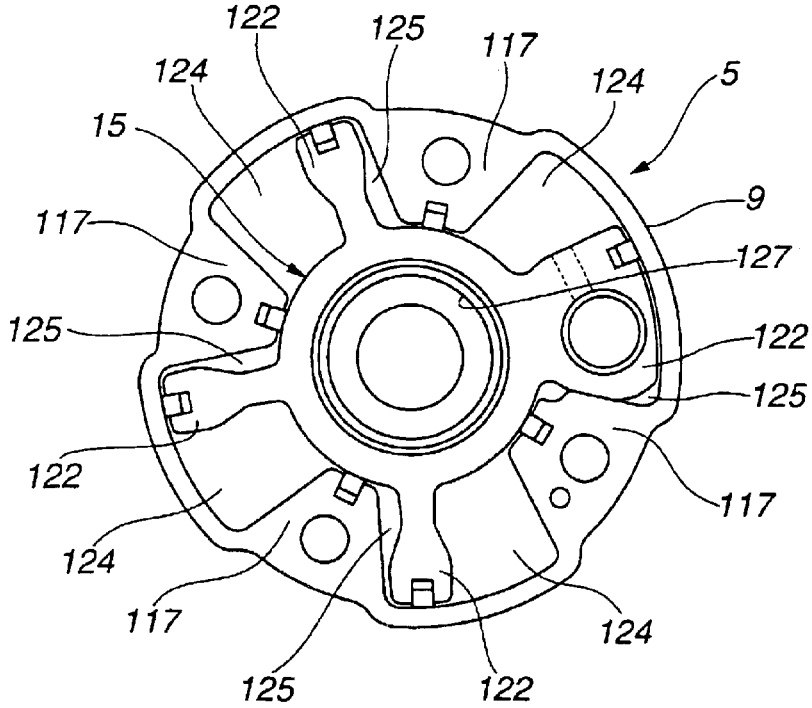
FIG. 4 is a view similar to FIG. 3, seen from the line 4—4 in FIG. 1.

Referring to FIGS. 1 and 4, vane rotor 115 comprises a rotor main body 121 disposed in the center of exhaust-side housing 9, four vanes 122 protruding radially outward from rotor main body 121, and a shank 123 extending from rotor main body 121 toward exhaust camshaft 2. The end face of shank 123 is coupled to an end of exhaust camshaft 2 by a cam bolt 114. Formed in the center of the front face of vane rotor 115 is a connection hole 127 in which a supply/discharge rod 126 protuberantly formed with the inside of VTC cover 28 is engaged relatively rotatably.

Referring to FIG. 1, exhaust housing 9 comprises a housing main body 39 for accommodating vanes 122 of vane rotor 115, a transmission block 40 having an outer periphery formed with exhaust-side transmission sprocket 12, and a reduced-diameter portion 41 extending axially from housing main body 39 to couple main body 39 to transmission block 40. Referring to FIG. 4, housing main body 39 comprises four partition walls 117 of trapezoidal section equidistantly formed with the peripheral wall to protrude radially inward from the inner periphery, defining advance and retard chambers 124, 125 on both sides of each vane 122 of vane rotor 115. Advance and retard chambers 124, 125 fluidly communicate with inner passages 128*a*, 128*b* formed through supply/discharge rod 126, respectively, and are connected therethrough to third and fourth hydraulic passages 129, 130 of hydraulic-pressure supply/discharge means 16.

Shank 123 of vane rotor 115 is arranged through reduced-diameter portion 41 and transmission block 40 of exhaust-side housing 9 to be coupled to exhaust camshaft 2, and serves to rotatably support housing 9 at the through portion. Torsion coil spring 38 is arranged on the outer periphery of reduced-diameter portion 41 of exhaust-side housing 9. Torsion coil spring 38 has on the side of housing main body 39 a first end 38*a* engaged with reduced-diameter portion 41, and on the side of transmission block 40 a second end 38*b* arranged through a slot 42 circumferentially formed in reduced-diameter portion 41 and engaged with shank 123 of vane rotor 115.

Torsion coil spring 38 is assembled in such a way as to have maximally increased diameter when exhaust-side phase alteration device 5 is in the phase state at engine start, i.e. maximum advance phase state, and to have decreased diameter, when the phase is changed therefrom to the advance direction after engine start, by relative rotation between exhaust-side housing 9 and vane rotor 115. The side face of first end 38*a* of torsion coil spring 38 slidably makes contact with the side face of housing main body 39, thereby preventing torsion coil spring 38 from being tipped. This ensures achievement of stable spring characteristics of torsion coil spring 38 at all times.

Transmission block 40 of exhaust-side housing 9 is engaged over the front end of reduced-diameter portion 41, and fixed by a bolt or tightening means 43 from the axial direction. Since exhaust-side transmission sprocket 12 is larger in diameter than torsion coil spring 38, the apparatus can easily be assembled by mounting torsion coil spring 38 to reduced-diameter portion 41, then fixing transmission block 40 by bolt 43.

A lubricating-fluid supply passage, not shown, is arranged to always supply lubricating fluid to drive-input sprocket 7 and intake-side and exhaust-side transmission sprockets 11, 12 in which chains 8, 10 are involved.

Referring to FIG. 1, a lock mechanism 50 serves to lock intake-side housing 6 and vane rotor 15 in their maximum retard positions at engine stop and the like, whereas a lock mechanism 51 serves to lock exhaust-side housing 9 and vane rotor 115 in their maximum advance positions at engine stop and the like.

Operation of the illustrative embodiment will be described. When the operating engine stops, the hydraulic pressure of hydraulic-pressure supply/discharge means 16 reduces gradually. Then, intake-side and exhaust-side phase alteration devices 4, 5 undergo force to vary vane rotors 15, 115 to their retard positions by alternating torque of camshaft 1, 2, i.e. fluctuating torque due to profile of a crank cam and force of a valve spring.

Then, with intake-side phase alteration device 4, vane rotor 15 is put back to its retard position by force of alternating torque, and locked in its maximum retard position by lock mechanism 50.

On the other hand, with exhaust-side phase alteration device 5, force of torsion coil spring 38 operates against alternating torque to put vane rotor 115 back to its advance position. And when vane rotor 115 is put back to its maximum advance position, exhaust-side phase alteration device 5 is locked therein by lock mechanism 51 in the same as intake-side phase alteration device 4.

Therefore, at engine restart, intake-side and exhaust-side phase alteration devices 4, 5 are both in the state suitable for engine restart.

When the engine is started, torque of the crankshaft is transmitted to drive-input sprocket 7 through chain 8, then to intake-side housing 6, which is further transmitted from intake-side transmission sprocket 11 through chain 10 to exhaust-side transmission sprocket 12. With this, intake-side and exhaust-side housings 6, 9 rotate synchronously under torque of the crankshaft. At the initial stage of engine start, since intake-side phase alteration device 4 and exhaust-side phase alteration device 5 are maintained in the maximum retard position and in maximum advance position, respectively, intake camshaft 1 and exhaust camshaft 2 open and close the engine valves at the retard timing and at the advance timing, respectively.

After engine start, when operation of electromagnetic switching valve 33 causes fluid communication of intake-side supply passage 31 and drain passage 32 with advance and retard chambers 24, 25 and fluid communication of exhaust-side supply passage 131 and drain passage 132 with retard and advance chambers 125, 124, vane rotors 15, 115 of intake-side and exhaust-side phase alteration devices 4, 5 are rotated to the maximum advance position and the maximum retard position, respectively. With this, intake camshaft 1 and exhaust camshaft 2 open and close the engine valves at the advance timing and at the retard timing, respectively.

In the illustrative embodiment, intake-side and exhaust-side phase alteration devices 4, 5 are disposed close to each other at the front ends of camshafts 1, 2. Particularly, drive-input sprocket 7 of intake-side housing 6 includes a large protrusion toward exhaust-side housing 9. However, reduced-diameter portion 41 located between housing main body 39 and exhaust-side transmission sprocket 12 (transmission block 40) is provided to exhaust housing 9 in the position corresponding to the protrusion of drive-input sprocket 7 of intake-side housing 6, thus securing an annular space of some axial width over the outer periphery of reduced-diameter portion 41.

In the illustrative embodiment, using the annular space over the outer periphery of reduced-diameter portion 41, torsion coil spring 38 for biasing vane rotor 115 to the advance direction is arranged therein, allowing prevention of an inconvenience that exhaust-side phase alteration device 5 protrudes greatly axially forward due to installation of the return spring. The reason why torsion coil spring 38 can be arranged in reduced-diameter portion 41 is that not only torsion coil spring 38 is large in axial length and relatively small in radial deformation amount, but also it is disposed to have reduced diameter when the phase is changed from the phase at engine start. Specifically, since torsion coil spring 38 have maximum outer diameter at engine start, preliminary simple setting of torsion coil spring 38 to prevent its interference with drive-input sprocket 7 in this initial state allows sure prevention of an inconvenience that torsion coil spring 38 interferes with drive-input sprocket 7 during operation of exhaust-side phase alteration device 5.

In the illustrative embodiment, therefore, the axial length of exhaust-side phase alteration device 5 can be reduced to thereby shorten the axial length of the whole engine block including phase alteration device 5, resulting in enhanced vehicle mountability of the apparatus.

Further, in the illustrative embodiment, torsion coil spring 38 is disposed on the outer periphery of reduced-diameter portion 41, there is an advantage that excessive deformation of torsion coil spring 38 in the reduced-diameter direction can be restricted by reduced-diameter portion 41.

Still further, in the illustrative embodiment, since lubricating fluid is supplied to sprockets 7, 11, 12, not only the engaged portions between sprockets 7, 11, 12 and chains 8, 10 can surely be lubricated, but also torsion coil spring 38 can be lubricated by lubricating fluid splashed by sprockets 7, 11, 12. This allows achievement of smooth flexible deformation of torsion coil spring 38 and prevention of characteristic variations thereof due to abrasion and abrasion powder from being produced.

As described above, according to the invention of the present application, since the torsion coil spring serving as a return spring is arranged in an annular space formed over the outer periphery of the reduced-diameter portion located between the housing main body of the exhaust-side phase alteration device and the exhaust-side transmission rotator, an installation space of the return spring does not protrude forward from the exhaust-side phase alteration device. The reason why the torsion coil spring can be arranged on the outer periphery of the reduced-diameter portion is that the torsion coil spring is disposed to have reduced diameter when the phase is changed from the phase at engine start, and thus does not interfere with the drive-input rotator of the intake-side phase alteration device, which faces the reduced-diameter portion. Therefore, the axial length of the apparatus in its entirety can be reduced, resulting in enhanced vehicle mountability thereof. Moreover, since the torsion coil spring is arranged on the outer periphery of the reduced-diameter portion, there is an advantage that excessive deformation of the torsion coil spring in the reduced-diameter direction can be restricted by the reduced-diameter portion.

Further, since lubricating fluid supplied to the sprockets is splashed to the torsion coil spring by rotation of the sprockets, the torsion coil spring can surely be lubricated without arranging an exclusive lubrication mechanism for lubricating the torsion coil spring. This allows not only achievement of a smooth reduction and enlargement of the diameter of the torsion coil spring, but also prevention of characteristic variations due to abrasion and abrasion powder from being produced.

Still further, tipping of the end of the torsion coil spring can be restricted by the side face of the housing main body of the exhaust-side phase alteration device, maintaining stable spring characteristics of the torsion coil spring at all times.

Furthermore, a biasing force of the torsion coil spring in the advance direction can surely be provided between the housing of the exhaust-side phase alteration device and the vane rotor with the torsion coil spring arranged on the outer periphery of the reduced-diameter portion. Moreover, the structure of the slot circumferentially formed in the reduced-diameter portion is very simple and facilitates mounting of the torsion coil spring, allowing manufacturing of the apparatus at low cost.

Further, after the torsion coil spring is disposed on the outer periphery of the reduced-diameter portion and engaged with the reduced-diameter portion and the shank of the vane rotor, the exhaust-side transmission rotator can be mounted to the reduced-diameter portion, providing excellent assembling workability.

Having described the invention of the present application in connection with the illustrative embodiment, it is noted that the invention of the present application is not limited thereto, and various changes and modifications can be made without departing from the scope of the invention of the present application. By way of example, in the illustrative embodiment, intake-side phase alteration device 4 includes a hydraulically actuated so-called vane-type device in the same way as exhaust-side phase alteration device 5. Optionally, intake-side phase alteration device 4 may include a device of other type such as electromagnetic type. Moreover, in the illustrative embodiment, the drive-input rotator and the intake-side and exhaust-side transmission rotators include sprockets 7, 11, 12 engaged with chains 8, 10. Optionally, the rotators may include pulleys frictionally engaged with belts.

The entire teaching of Japanese Patent Application P2003-289671 filed Aug. 8, 2003 are hereby incorporated by reference.

What is claimed:

1. A variable valve actuation (VVA) apparatus for an internal combustion engine, comprising:

an intake camshaft which drives an intake valve;

an exhaust camshaft which drives an exhaust valve;

an intake-side phase alteration device arranged at one end of the intake camshaft, the intake-side phase alteration device changing a relative rotation phase between a crankshaft and the intake camshaft;

an exhaust-side phase alteration device arranged at one end of the exhaust camshaft, the exhaust-side phase alteration device changing a relative rotation phase between the crankshaft and the exhaust camshaft;

a drive-input rotator provided to the intake-side phase alteration device, the drive-input rotator receiving a torque of the crankshaft;

an intake-side transmission rotator provided to the intake-side phase alteration device, the intake-side transmission rotator being disposed closer to the intake camshaft than the drive-input rotator, the intake-side transmission rotator being smaller in outer diameter than the drive-input rotator, the intake-side transmission rotator rotating together with the drive-input rotator;

an exhaust-side transmission rotator which receives a torque of the intake-side transmission rotator, the exhaust-side transmission rotator being the same in outer diameter as the intake-side transmission rotator;

a reduced-diameter portion arranged between the exhaust-side phase alteration device and the exhaust-side transmission rotator; and a biasing member which biases the exhaust camshaft to an advance direction with respect to the crankshaft, the biasing member having a reduced diameter when a phase of the exhaust-side phase alteration device is changed from its phase at engine start.

2. The VVA apparatus as claimed in claim 1, wherein the biasing member comprises a torsion coil spring.

3. The VVA apparatus as claimed in claim 1, wherein the drive-input rotator comprises a drive-input sprocket, wherein the drive-input sprocket receives the torque through a chain.

4. The VVA apparatus as claimed in claim 3, wherein the drive-input sprocket rotates at a 1:2 ratio with respect to rotation of the crankshaft.

5. The VVA apparatus as claimed in claim 1, wherein the intake-side transmission rotator comprises an intake-side transmission sprocket, and the exhaust-side transmission rotator comprises an exhaust-side transmission sprocket having the same number of teeth as that of the intake-side transmission sprocket, wherein the exhaust-side transmission sprocket receives the torque through a chain looped between the two sprockets.

6. The VVA apparatus as claimed in claim 1, wherein the drive-input rotator, the intake-side transmission rotator, and the exhaust-side transmission rotator comprise sprockets engaged with chains, and wherein the apparatus further comprises a supply passage serving to supply lubricating fluid to the sprockets.

7. A variable valve actuation (VVA) apparatus for an internal combustion engine, comprising:

an intake camshaft which drives an intake valve;

an exhaust camshaft which drives an exhaust valve;

an intake-side phase alteration device arranged at one end of the intake camshaft, the intake-side phase alteration device changing a relative rotation phase between a crankshaft and the intake camshaft;

an exhaust-side phase alteration device arranged at one end of the exhaust camshaft, the exhaust-side phase alteration device changing a relative rotation phase between the crankshaft and the exhaust camshaft, the exhaust-side phase alteration device comprising a housing and a vane rotor rotating together with the exhaust camshaft and mounted to the housing to be rotatable relatively, the vane rotor comprising vanes protuberantly arranged on an outer periphery and dividing an inside space of the housing into advance and retard chambers, wherein the housing and the vane rotor are rotated relatively by selectively supplying and discharging a working fluid from the advance and retard chambers;

a drive-input rotator arranged in a housing of intake-side phase alteration device, the drive-input rotator receiving a torque of the crankshaft;

an intake-side transmission rotator arranged in a housing of the intake-side phase alteration device, the intake-side transmission rotator being disposed closer to the intake camshaft than the drive-input rotator and being smaller in diameter than the drive-input rotator;

an exhaust-side transmission rotator arranged in the housing of the exhaust-side phase alteration device in a position corresponding to the intake-side transmission rotator, the exhaust-side transmission rotator having the same outer diameter as that of the intake-side transmission rotator and receiving a torque of the intake-side transmission rotator;

a reduced-diameter portion provided to the housing of the exhaust-side phase alteration device between a main body of the housing for accommodating the vanes and the exhaust-side transmission rotator, the reduced-diameter portion corresponding to the drive-input rotator; and a return spring arranged between the housing and vane rotor of the exhaust-side phase alteration device to bias the two in an advance direction, the return spring comprising a torsion coil spring, the torsion coil spring being disposed on an outer periphery of the reduced-diameter portion to have a reduced diameter when a phase is changed from a phase at engine start.

8. The VVA apparatus as claimed in claim 7, wherein the torsion coil spring has one end with a side face slidably making contact with a side face of the main body of the housing of the exhaust-side phase alteration device.

9. The VVA apparatus as claimed in claim 7, further comprising a shank arranged through the reduced-diameter portion of the exhaust-side phase alteration device to protrude from the vane rotor, wherein the reduced-diameter portion is formed with a circumferential slot, the torsion coil spring having one end engaged with the reduced-diameter portion and another end engaged with the shank through the slot.

10. The VVA apparatus as claimed in claim 9, wherein the exhaust-side transmission rotator comprises a member separate and distinct from the reduced-diameter portion, wherein the apparatus further comprises a tightening device which couples the exhaust-side transmission rotator to the reduced-diameter portion.

11. The VVA apparatus as claimed in claim 7, wherein the intake-side phase alteration device comprises a housing and a vane rotor rotating together with the intake camshaft and mounted to the housing to be rotatable relatively, the vane rotor comprising vanes protuberantly arranged on an outer periphery and dividing an inside space of the housing into advance and retard chambers, wherein the housing and the vane rotor are rotated relatively by selectively supplying and discharging a working fluid from the advance and retard chambers.

12. The VVA apparatus as claimed in claim 7, further comprising an intake-side electromagnetic switching valve selectively supplying and discharging the working fluid from the advance and retard chambers of the intake-side phase alteration device.

13. The VVA apparatus as claimed in claim 12, further comprising an exhaust-side electromagnetic switching valve selectively supplying and discharging the working fluid from the advance and retard chambers of the exhaust-side phase alteration device.

14. The VVA apparatus as claimed in claim 13, further comprising an oil pump supplying oil in an oil pan to the intake-side electromagnetic switching valve and the exhaust-side electromagnetic switching valve.

15. The VVA apparatus as claimed in claim 7, further comprising a VTC cover, an intake-side supply/discharge rod provided to the VTC cover and supplying and discharging the working fluid from the advance and retard chambers of the intake-side phase alteration device, and an exhaust-side supply/discharge rod provided to the VTC cover and supplying and discharging the working fluid from the advance and retard chambers of the exhaust-side phase alteration device.

16. The VVA apparatus as claimed in claim 7, further comprising an intake-side lock mechanism provided to the intake-side phase alteration device, the lock mechanism serving to lock the intake-side housing and the vane rotor in their maximum retard positions at engine stop.

17. The VVA apparatus as claimed in claim 7, further comprising an exhaust-side lock mechanism provided to the exhaust-side phase alteration device, the lock mechanism serving to lock the exhaust-side housing and the vane rotor in their maximum advance positions at engine stop.

18. The VVA apparatus as claimed in claim 7, wherein the torsion coil spring has a housing-side end engaged with the reduce-diameter portion, and an exhaust-camshaft-side end arranged through a slot circumferentially formed in the reduced-diameter portion and engaged with the vane rotor.

19. The VVA apparatus as claimed in claim 7, wherein the torsion coil spring is constructed to put back the vane rotor of the exhaust-side phase alteration device to its maximum advance position at engine stop.

20. A variable valve actuation (VVA) apparatus for an internal combustion engine, comprising:

an intake camshaft which drives an intake valve;

an exhaust camshaft which drives an exhaust valve;

an intake-side phase alteration device arranged at one end of the intake camshaft, the intake-side phase alteration device changing a relative rotation phase between a crankshaft and the intake camshaft;

an exhaust-side phase alteration device arranged at one end of the exhaust camshaft, the exhaust-side phase alteration device changing a relative rotation phase between the crankshaft and the exhaust camshaft, the exhaust-side phase alteration device comprising a housing and a vane rotor rotating together with the exhaust camshaft and mounted to the housing to be rotatable relatively, the vane rotor comprising vanes protuberantly arranged on an outer periphery and dividing an inside space of the housing into advance and retard chambers, wherein the housing and the vane rotor are rotated relatively by selectively supplying and discharging a working fluid from the advance and retard chambers;

a drive-input rotator arranged in a housing of intake-side phase alteration device, the drive-input rotator receiving a torque of the crankshaft;

an intake-side transmission rotator arranged in a housing of the intake-side phase alteration device, the intake-side transmission rotator being disposed closer to the intake camshaft than the drive-input rotator and being smaller in diameter than the drive-input rotator;

an exhaust-side transmission rotator arranged in the housing of the exhaust-side phase alteration device in a position corresponding to the intake-side transmission rotator, the exhaust-side transmission rotator having the same outer diameter as that of the intake-side transmission rotator and receiving a torque of the intake-side transmission rotator;

a reduced-diameter portion arranged in the housing of the exhaust-side phase alteration device between a main body of the housing for accommodating the vanes and the exhaust-side transmission rotator, the reduced-diameter portion corresponding to the drive-input rotator; and means, arranged between the housing and vane rotor of the exhaust-side phase alteration device, for biasing the two in an advance direction, the biasing means comprising a torsion coil spring, the torsion coil spring being disposed on an outer periphery of the reduced-diameter portion to have a reduced diameter when a phase is changed from a phase at engine start.

* * * * *